US007045916B2

(12) United States Patent
Stolt et al.

(10) Patent No.: US 7,045,916 B2
(45) Date of Patent: May 16, 2006

(54) ELECTRONIC FUEL SELECTION SWITCH SYSTEM

(75) Inventors: Peter E. Stolt, Crystal, MN (US); Robert D. Juntunen, Minnetonka, MN (US)

(73) Assignee: Honeywell International Inc., Morristown, NJ (US)

( * ) Notice: Subject to any disclaimer, the term of this patent is extended or adjusted under 35 U.S.C. 154(b) by 398 days.

(21) Appl. No.: 10/448,484

(22) Filed: May 30, 2003

(65) Prior Publication Data

US 2004/0240141 A1 Dec. 2, 2004

(51) Int. Cl.
*H01H 35/00* (2006.01)
*F02D 19/10* (2006.01)

(52) U.S. Cl. ..... 307/116; 123/27 GE; 123/525; 123/575

(58) Field of Classification Search ..... 123/27 GE, 123/525, 575; 307/116
See application file for complete search history.

(56) References Cited

U.S. PATENT DOCUMENTS 4,061,463 A 12/1977 Bennett
4,349,077 A * 9/1982 Sekiguchi et al. ..... 180/41
4,420,976 A * 12/1983 Orloff et al. ..... 73/304 C
4,529,373 A 7/1985 Ortlinghaus
4,541,367 A * 9/1985 Lindberg ..... 123/25 M
4,546,735 A 10/1985 O'Neal
4,556,077 A 12/1985 Peyton
4,641,625 A * 2/1987 Smith ..... 123/575
4,788,520 A 11/1988 Strand
4,999,792 A 3/1991 Anderson et al.
5,062,792 A 11/1991 Maghon
5,072,879 A 12/1991 Noye
5,224,457 A * 7/1993 Arsenault et al. ..... 123/526
5,307,050 A 4/1994 Patton et al.
5,309,445 A 5/1994 Bartels
5,365,223 A 11/1994 Sigafus
5,370,097 A * 12/1994 Davis ..... 123/526
5,379,740 A * 1/1995 Moore et al. ..... 123/478
5,546,002 A * 8/1996 Hickl ..... 324/418
5,999,888 A 12/1999 Aubee
6,003,478 A 12/1999 Huber
6,035,837 A * 3/2000 Cohen et al. ..... 123/575
6,068,470 A 5/2000 Zarzatis et al.
6,297,569 B1 10/2001 Bartels et al.
2002/0185086 A1* 12/2002 Newman et al. ..... 123/1 A

* cited by examiner

*Primary Examiner*—Lynn Feild
*Assistant Examiner*—Michael Rutland-Wallis
(74) *Attorney, Agent, or Firm*—Gregory M. Ansems

(57) ABSTRACT

Devices and methods for providing a switch for selecting which of a number of fuel valves receives power. The switch preferably provides a delay between the powering down of a first fuel valve and the powering up of a second fuel valve. Also included are systems and methods for providing an electrical, printed circuit board mountable safety switch for switching fuel sources in a multi-fuel burning system.

34 Claims, 9 Drawing Sheets

| State | Time | Main Switch Position (102) | First Switch Coil (132) | First Switch Contacts (134, 136) | Burner A (110) | Second Switch Coil (142) | Second Switch Contacts (144, 146) | Burner B (112) |
|---|---|---|---|---|---|---|---|---|
| 1 | Steady, B On | 2 | Shorted | Open | Off | >TO2 | Closed | On |
| 2 | X | 1 | Shorted | Open | Off | >TO2, dropping | Closed | Off |
| 3 | X+D2 | 1 | <TC1, charging | Open | Off | =TO2, dropping | Open | Off |
| 4 | X+D2+E1 | 1 | =TC1, charging | Closed | On | Shorted | Open | Off |
| 5 | Steady, A On | 1 | >TO1 | Closed | On | Shorted | Open | Off |
| 6 | Y | 2 | >TO1, dropping | Closed | Off | Shorted | Open | Off |
| 7 | Y+D1 | 2 | =TO1, dropping | Open | Off | <TC2, charging | Open | Off |
| 8 | Y+D1+E2 | 2 | Shorted | Open | Off | =TC2, charging | Closed | On |
| 9 | Center Off | Off | No Power | Open | Off | No Power | Open | Off |

* TO1 = Threshold open voltage for first switch coil; TC1 = Threshold close voltage for first switch coil; TO2 = Threshold open voltage for second switch coil; TC2 = Threshold close voltage for second switch coil; X=time at which switch from powering 2 to powering 1, Y=time at which switch from powering 1 to powering 2

** Note D1, D2 are the times at which, given the TO1 and TO2 of the first and second reactive circuits, the threshold voltage is crossed going down

*** Note E1, E2 are the times at which, given the TC1 and TC2 of the first and second reactive circuits, the threshold voltage is crossed going up

*FIG. 5*

Missing One Capacitor on Both Sides
1-2

Missing One Capacitor on Both Sides
2-1

ELECTRONIC FUEL SELECTION SWITCH SYSTEM

FIELD OF THE INVENTION

The present invention is related to methods and systems for introducing a delay to a fuel selection switch. In particular, the present invention is related to providing an electronic switch system that safely provides both a switching and a hesitation function.

BACKGROUND OF THE INVENTION

Dual or multi-fuel burners are used for a variety of reasons in a number of applications. When switching from the use of one fuel to another, safety regulations require the inclusion of a delay to interrupt burner operation to prevent the firing of the previously used fuel from interfering with the firing of the newly selected fuel. The amount of delay needed is generally less than a second. In the past, mechanical hesitation mechanisms have been used to create a delay. For example, some hesitation switches require a slide, switch or button to be depressed or moved to deactivate a first fuel valve. The slide, switch or button is then released for a moment, and depressed or moved again to activate a second fuel valve. Such mechanical hesitation switches are often bulky and typically are not suited for mounting on a printed circuit board. Further, a mechanical switch of this sort typically is not easily or readily integrated with electronics, which may perform other safety and/or operational functions.

SUMMARY OF THE INVENTION

The present invention provides in one illustrative embodiment an electronic fuel selection switch that includes both switching and delay features. In some embodiments, the switches use components that are readily mountable to a printed circuit board and that allow easy integration with other electronics that can provide additional safety and monitoring functions. In addition, and in some embodiments, the electronic fuel selection switch of the present invention may be compliant with first order Failure Mode Effects Analysis (FMEA), allowing a component to fail while still providing safe operation.

In one illustrative embodiment, the electronic switch has both a first switching device and a second switching device. The switching devices are preferably configured to open and close in response to a corresponding control signal. Illustrative switching devices include, for example, relays, transistors, or any other suitable switching devices, as desired.

A first delay element and a second delay element are also provided. The first and second delay elements may be analog delay circuit such as a reactive circuit, a digital delay circuit, or a combination thereof, as desired. The first delay element and the second delay element each include an input signal and an output signal. The input signals are controlled, either directly or indirectly, by a mechanical or other switch that causes one of the input signals to be in one state (e.g. high) and the other input signal to be in another state (e.g. low). In one embodiment, the input signal of the first delay element is high when a first fuel is selected and low when a second fuel is selected, and the input signal of the second delay element is low when the first fuel is selected and high when the second fuel is selected.

The output of the first delay element may be used as the control signal for the first switching device, and the output of the second delay element may be used as the control signal for the second switching device. The delay elements may help provide a delay to the control signals that cause the closing or opening of the first and second switching devices after a change in the input signals to the first and second delay elements is sensed.

When used to switch between two fuel valves of a duel fuel burner system, power is supplied to the first delay element when a first fuel is selected. The first switching device, however, preferably only allows power to pass to the first fuel valve after the output signal of the first delay element crosses a predetermined threshold. As such, and in one illustrative embodiment, the control signal of the first switching device is taken from the output signal of the first delay element. Thus, when the output signal of the first delay element reaches the predetermined threshold, the first switching device may snap closed to provide power to the first fuel valve.

When a second fuel valve is selected, power is supplied to the second delay element, and the first delay element is disabled and reset, as are the first switching device, and the first fuel valve. Like above, the second switching device preferably only allows power to pass to the second fuel valve after the output signal of the second delay element reaches a predetermined threshold. As such, and in one illustrative embodiment, the control signal of the second switching device is taken from the output signal of the second delay element. Thus, when the output signal of the second delay element reaches the predetermined threshold, the second switching device may snap closed to provide power to the second fuel valve.

In some embodiments, it may be desirable to change the delay of one or both of the first and second delay elements. This may help ensure that there is delay between the deselection of one fuel valve and the selection of another fuel valve, and in some cases, that there is sufficient delay even when one (or more) components of the switching circuitry fails, keeping in compliance with Failure Mode Effects Analysis (FMEA).

For example, and in one illustrative embodiment, a third switching device may be provided to disable the first delay element, and a fourth switching device may be provided disable the second delay element. The third switching device may disable and reset the first delay element when the output of the second delay element has reached a predetermined threshold. The fourth switching device may disable and reset the second delay element when the output of the first delay element has reached a predetermined threshold.

In some embodiments, the first and fourth switching devices are two commonly controlled poles of a relay, and the second and third switching devices are two commonly controlled poles of another relay. This cross-coupling of first and fourth switching devices, as well as the cross-coupling of the second and third switching devices, may further help ensure that there is delay between the deselection of one fuel valve and the selection of another fuel valve.

While the electronic switch of the present invention is preferably used as an electronic fuel selection switch, many other applications are contemplated. It is contemplated that the present invention may be used in any application where a delay is desirable between the deselection of one state and the selection of another.

BRIEF DESCRIPTION OF THE FIGURES

FIG. 5 is a table illustrating several operational steps for an illustrative embodiment of the invention;

DETAILED DESCRIPTION OF SEVERAL ILLUSTRATIVE EMBODIMENTS

Figure 1A:
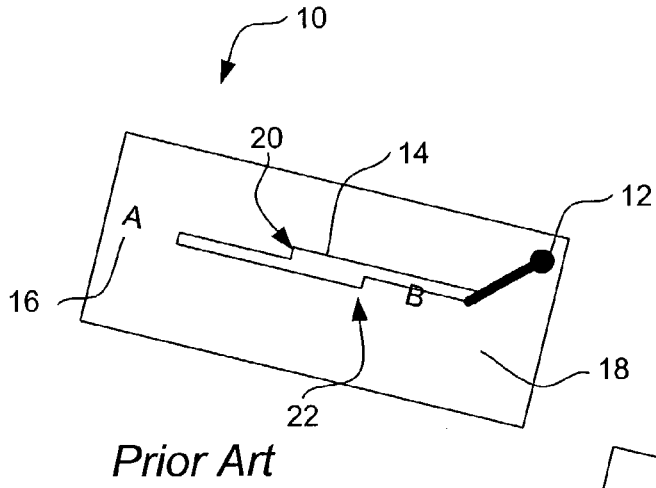
FIGS. 1A–1D illustrate a highly simplified illustrative prior art fuel selection switch including a mechanical delay.

The following detailed description should be read with reference to the drawings. The drawings, which are not necessarily to scale, depict illustrative embodiments and are not intended to limit the scope of the invention.

FIGS. 1A–1D illustrate a highly simplified prior art mechanical fuel selection switch that includes a mechanical delay. The switch 10 includes a lever 12 that can move within a slide area 14. A first position 16 indicates power supply to an "A" device, while a second position 18 indicates power supply to a "B" device. The slide area 14 also includes a first intermediate position 20 and a second intermediate position 22.

Figure 1B:
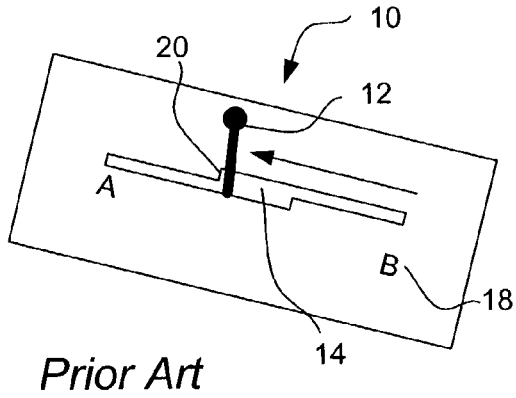
Figure 1C:
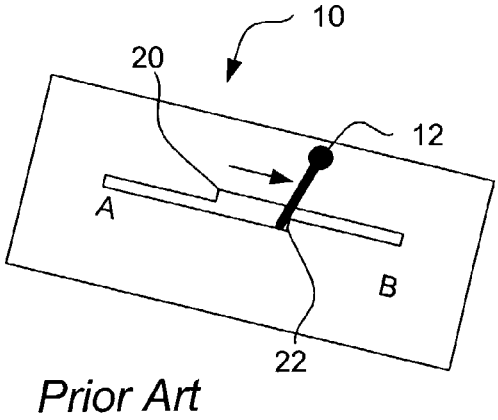
Figure 1D:
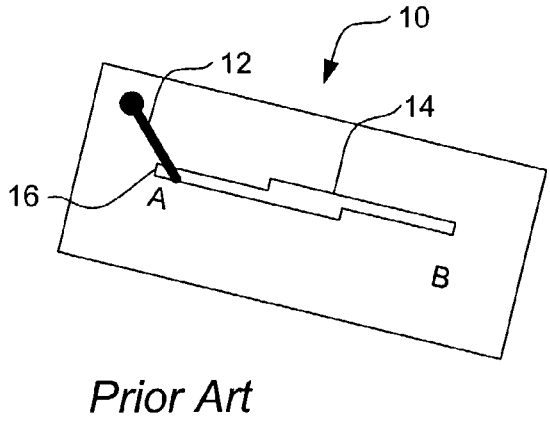

The switch 10 is illustrated in FIG. 1A with the lever 12 placed in the second position, for powering the "B" device. FIG. 1B illustrates a first step in switching power from the "A" device to the "B" device. The lever 12 is moved from the second position 18 to a first intermediate position 20. This movement disconnects the power supply from the "B" device. The switch 10 is configured such that the lever 12 cannot pass beyond the first intermediate position 20 to reach the first position 16 and power the "A" device. Instead, the lever 12 is stopped, and must move as shown in FIG. 1C, back toward the second intermediate position 22, before the switch 10 will allow the lever 12 to be moved as shown by FIG. 1D, over to the first position 16.

The delay time required by safety regulations is typically relatively short. A simple mechanism forcing a mechanical delay, such as the extra time it takes to move the lever 12 from the first intermediate location 20 to the second intermediate location 22, along with the time taken to change the direction of movement, is typically sufficient. However, to make a durable and rugged system, such a switch must typically withstand repeated physical movement. Further, mechanical switching devices such as that shown in FIGS. 1A–1D are typically difficult to mount on a printed circuit board with other circuit components.

Figure 2A:
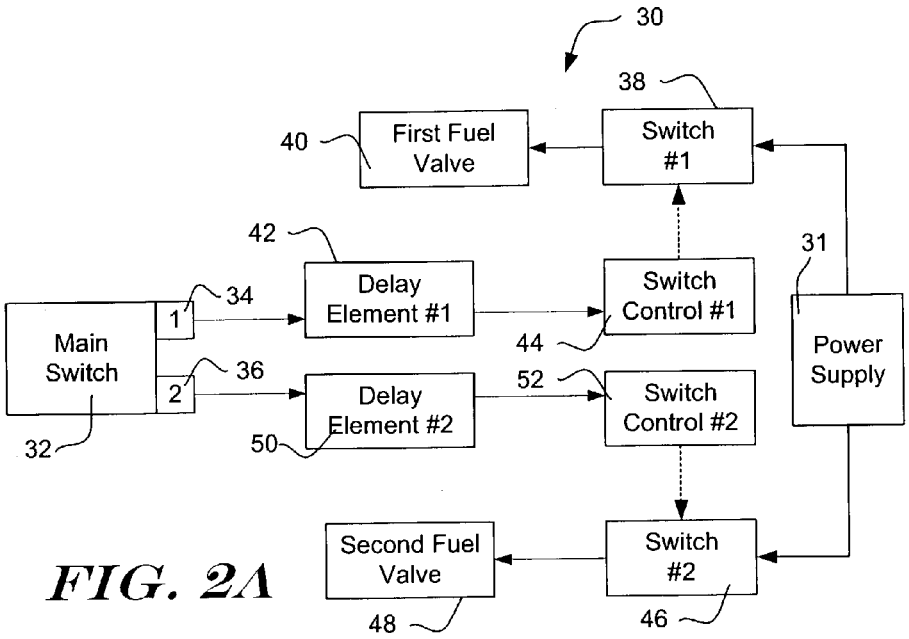
FIG. 2A shows a block diagram of an illustrative embodiment of the invention.

FIG. 2A shows a block diagram of an illustrative embodiment of the invention. The fuel selection switch is generally shown at 30, and includes a main switch 32 having a first output 34 and a second output 36. The main switch 32 may be a circuit board mountable switch that creates and breaks mechanical connections when switched, but it may also be any of a wide variety of touch-button switches, toggling devices, and/or electrical or electro-mechanical switching devices. The main switch 32 may receive power from a power supply 31 (connection not shown), or it may receive power from another source, for example, through an AC/DC conversion circuit, as desired. For example, if the power supply 31 is an ordinary sixty hertz supply, the main switch 32 may receive the input AC power, or it may receive a lesser voltage or a rectified form of power using other power conditioning circuitry.

The power supply 31 is coupled to a first switch 38, which is in turn is coupled to a first fuel valve 40. The first switch 38 may be any type of selectively openable or closeable elements that can make or break an electrical connection. In one example, the first switch 38 is provided in the form of a relay that places two terminals in electrical connection by creating a physical movement of a contactor. In other embodiments, electrical connections may be made by other switching devices, including semiconductors, for example, with the use of a MOS-based electronic switch or other junction or field effect transistor devices, or any other suitable switching device, as desired. When single order Failure Mode Effects Analysis (FMEA) compliance is desired, the failure modes of the switching device must be analyzed and possibly mitigated.

The first output 34 of main switch 32 is coupled to a first delay element 42, which in turn provides a signal to a first switch control 44. The first switch control 44 is coupled to the first switch 38 so that the connection made by the first switch 38 is controlled by the signal received by the first switch control 44. In one illustrative embodiment, the first switch control 44 and first switch 38 are provided using a relay, with the first switch control 44 being the relay coil and the first switch being the relay contacts. The first delay element 42 may be any form of delay element including, for example, basic RC, RL, LC and RLC circuits or more complicated or higher order circuits, and/or digital timers or other digital or analog delay elements, as desired. In one illustrative embodiment, the first delay element includes an RC configuration having a resistive element in parallel with a capacitive element, with the signal received by the first switch control 44 being taken across the capacitive element. Rectifiers, diodes or other nonlinear and linear devices may be provided in series with the main switch 32 to the reactive circuit to allow an AC type of power source to be used in conjunction with the RC type of reactive circuit.

The power supply 31 is also coupled to a second switch 46, which in turn is coupled to a second fuel valve 48. The second output 36 of the main switch 32 is coupled to a second delay element 50, which in turn provides a signal to a second switch control 52, in a similar fashion as described above with reference to the first switch control 44. In operation, the delay elements 42 and 50 are used to delay the switching of power between the fuel valves 40 and 48, as further explained below. The main switch 32, switch controls 44 and 52, and switches 38 and 46 determine which valve receives power. However, when either valve is switched on to receive power, the safety switching device 30 provides a delay to help prevent immediate power up for the fuel valves 40 and 48.

In one example, suppose the main switch 32 has been set to power the second output 36 for a period of time. Then, the main switch 32 is manipulated to cause it to power the first output 34 instead. At the time of switching, the first delay element 42 has been disabled for some period of time, such that the first switch control 44 has received a signal which causes the first switch 38 to open and prevent power being supplied to the first fuel valve 40. When power is received by the first delay element 42, the first delay element 42 provides a delay before enabling the first switch control 44.

Once enabled, the first switch control 44 will close the first switch 38, allowing power to be supplied to the first fuel valve 40.

Figure 2B:
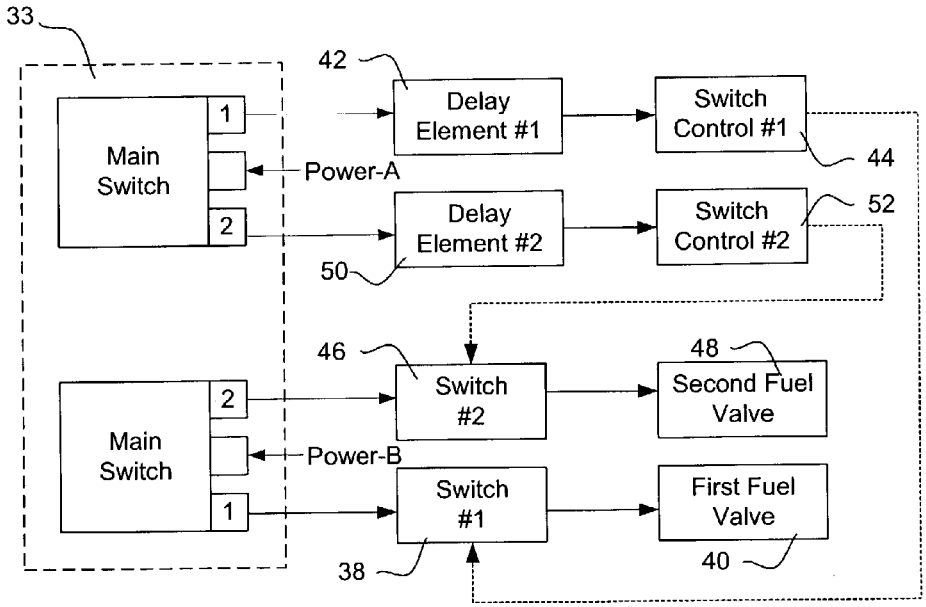
FIG. 2B shows a block diagram of another illustrative embodiment of the invention.

FIG. 2B shows a block diagram of another illustrative embodiment of the invention. The fuel selection switch in this embodiment includes a double pole double throw main switch 33. Each pole of the main switch 33 is shown coupled to a different power supply (Power-A and Power-B), but this is not required in all embodiments.

The first output (labeled "1") of the first pole of the main switch 33 is coupled to a first delay element 42, which in turn provides a signal to a first switch control 44. The second output (labeled "2") of the first pole of the main switch 33 is coupled to a second delay element 50, which in turn provides a signal to a second switch control 52. The first output (labeled "1") of the second pole of the main switch 33 is coupled to a first switch 38, which when closed, provides power to a first fuel valve 40. The second output (labeled "2") of the second pole of the main switch 33 is coupled to a second switch 46, which when closed, provides power to a second fuel valve 48. The first switch control 44 preferably activates the first switch 38 once enabled by the first delay element 42, and the second switch control 52 activates the second switch 46 once enabled by the second delay element 50. In one illustrative embodiment, the first switch control 44 and first switch 38 may be provided as a relay, with the first switch control 44 being the relay coil and the first switch 38 being the relay contacts. Likewise, the second switch control 52 and second switch 46 may be provided as a relay, with the second switch control 52 being the relay coil and the second switch 46 being the relay contacts.

The first and second delay circuits 42 and 50 may be any form of delay circuit including, for example, basic RC, RL, LC and RLC circuits or more complicated or higher order circuits, or even digital timer or other digital delay circuits, as desired.

In operation, suppose the main switch 33 has been set to power the second output for both poles of the main switch 33. That is Power-A is delivered to second delay element 50 and Power-B is delivered to the second switch 46. Then suppose the main switch 33 is manipulated to cause it to power the first output of both poles of the main switch 33. When switched, power is immediately cut off from the second pole of the main switch 33. This immediately cuts off power to the second switch 46 and thus the second fuel valve 48, which closes the second fuel valve 48. At the same time, power is supplied to the first delay element 42, which causes the first delay element 42 to begin accumulating time. After accumulating a predetermined time, the first delay element 42 enables the first switch control 44 to close the first switch 38, which enables the first fuel valve 40.

Figure 3:
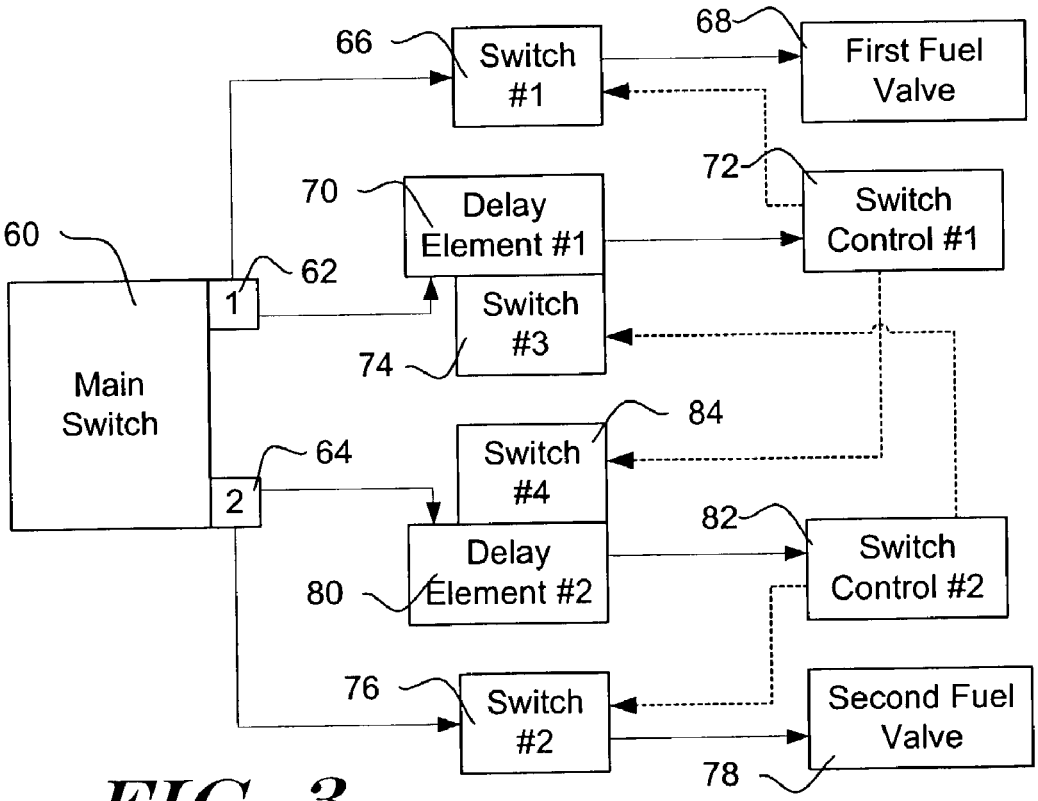
FIG. 3 shows a block diagram of yet another illustrative embodiment of the invention including additional feedback capabilities.

FIG. 3 shows a block diagram of another illustrative embodiment of the invention including additional feedback capabilities. In FIG. 3, the power supply (not shown) may be directed through a main switch 60. The main switch 60 includes a first output 62 and a second output 64. The first output 62 provides power to a first switch 66, which when switched on, provides power to a first fuel valve 68. The first output 62 is also coupled to a first delay element 70, which provides a signal to a first switch control 72. The first switch control provides a control signal to the first switch 66, as shown. The second output 64 is coupled to a second switch 76, which when switched on, provides power to a second fuel valve 78. The second output 64 is also coupled to a second delay element 80, which in turn provides a signal to a second switch control 82. The second switch control 82 provides a control signal to the second switch 76, as shown.

A third switch 74 is used to disable the first delay element 70 and reset any time accumulation, and a fourth switch 84 is used to disable the second delay element 80 and reset any time accumulation. Preferably, the third switch 74 is switched coincidently with the second switch 76, with both controlled by a common control signal provided by switch control 82. Likewise, the fourth switch 84 is switched coincidently with the first switch 66, with both controlled by a common control signal provided by switch control 72.

This configuration, if desired, allows for additional safety control and delay, as further explained below. In particular, this configuration allows the third switch 74 and the fourth switch 84 to modify the output of the delay elements 70 and 80. Because the delay elements 70 and 80 supply the respective switch control signals to switch controls 72 and 82, this may allow the switch controls 72 and 82 to selectively disable each other as further explained below.

For example, again, suppose the main switch 60 is left in position to power the second output 64 for a period of time and then manipulated to cause the main switch 60 to provide power to the first output 62. With the second output 64 powered for a relatively long period of time, the second delay element 80 has already enabled the second switch control 82, thereby closing the second switch 76 and providing power from the main switch second output 64 to the second fuel valve 78. With the second switch control 82 powered in this way, the third switch 74 is also closed, such that the output of the first delay element 70 is disabled and reset so that any time accumulation is eliminated. This means that while the second switch control 82 is enabled, the first switch control 72 is disabled and the first switch 66 is open, regardless of whether power is supplied through the first output 62. Further, disabling the first delay element 70 prevents the first delay element 70 from accumulating any time.

When the main switch 60 is manipulated to provide power through the first output 62, power is cut off through the second output 64 and the second delay element 80stops receiving power. Also, power is immediately cut off from the second switch 76, and thus the second fuel valve 78.

With no further power supplied to the second delay element 80, the signal supplied by the second delay element 80 causes the second switch control 82 to open both the second switch 76 and the third switch 74 after the accumulated time expires. Once the third switch 74 opens, the first delay element 70 can begin accumulating time. Once the first delay element 70 accumulates a predetermined amount of time, the first switch control 72 caused both the first switch 66 and the fourth switch 84 to close, which enables power to be supplied to the first fuel valve 68 and disables and resets the output of the second delay element 80. In some embodiments, the first and fourth switches may be two commonly controlled poles of a relay, and the second and third switches may be two commonly controlled poles of another relay.

In many embodiments, the switch controls 72 and 82 and delay elements 70 and 80 may share similar characteristics. In some embodiments, identical, matched or paired circuits and/or devices may be used for each side in order to provide consistent operation. In other embodiments, various characteristics including, for example, delay accumulation times, time constants, threshold voltages, and/or other power conditioning functions (i.e. rectification, DC/AC switching, step-down or voltage limiting) may be provided on one side and/or the other, depending upon the requirements of the fuel valves 68 and 78 and the desired time delays or other characteristics.

Figure 4:
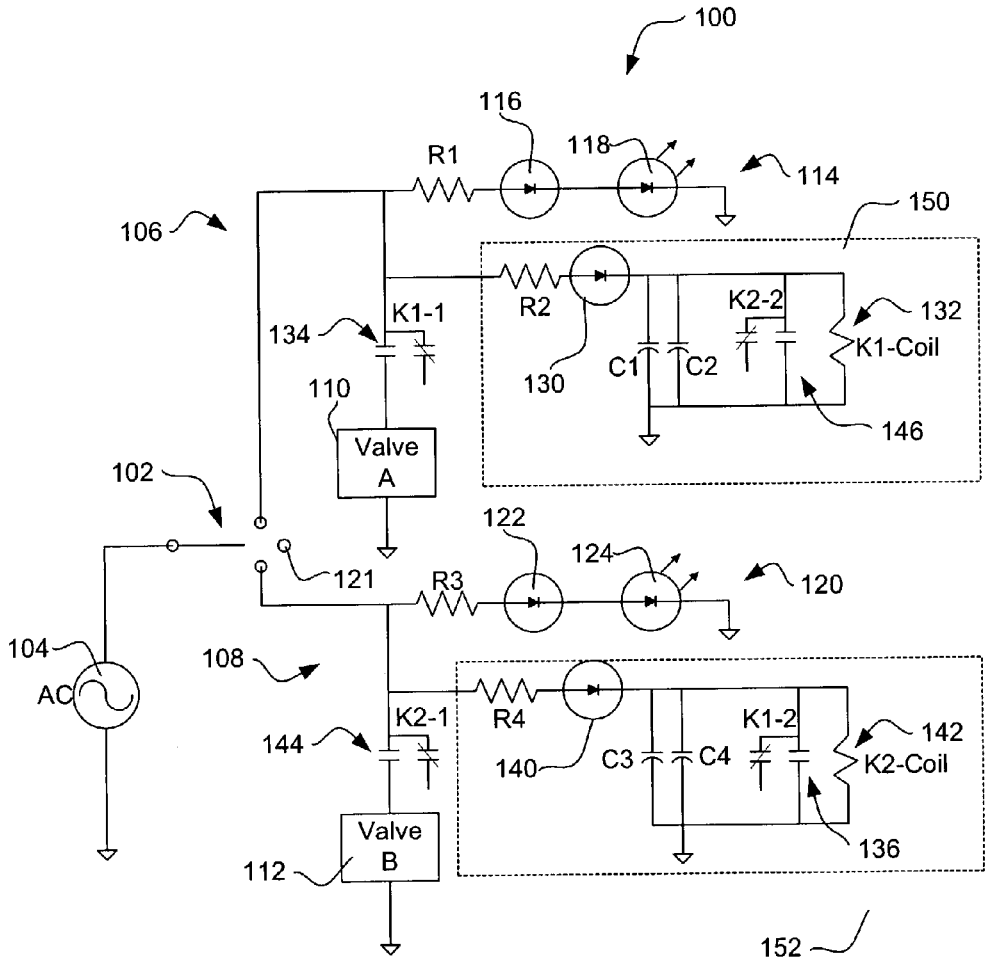
FIG. 4 shows an electronic device schematic for another illustrative embodiment of the invention.

FIG. 4 shows a schematic diagram of an illustrative embodiment of the embodiment shown in FIG. 3. FIG. 5 is a table illustrating several operational steps for the illustrative embodiment of FIG. 4, where FIG. 5 may be used in conjunction with FIG. 4 to explain the process of operation. The following paragraphs provide a narrative explanation for the illustrative embodiment of FIG. 4, while FIG. 5 may be understood to provide a more compact version of the narrative. For the purposes of illustration, the embodiment shown in FIG. 4 is explained below in terms of one application for the present invention. It should be understood, however, that the present invention may be used in any variety of different applications.

In FIG. 4, the illustrative embodiment 100 includes a main switch 102 coupled to an AC power supply 104. The switch 102 is depicted as a single pole double throw switch with a center off position, though any suitable switch device may be used. The center off position is shown at 121, in which neither fuel is selected. The switch 102 may be provided as a mechanical switch or may use any combination of mechanical, electrical, electro-mechanical or other devices. The switch 102 is coupled to a first side 106 and a second side 108. The first side 106 is ultimately coupled to valve A 110 which, for the illustrative embodiment, is used to control the flow of a first type of fuel such as natural gas in a multi-fuel burner system. The second side 108 is ultimately coupled to valve B 112 which, for the illustrative embodiment, is used to control system the flow of a second type of fuel such as fuel oil, for example, in the multi-fuel burner system.

The first side 106 includes an optional indicator branch 114, which may be omitted in some embodiments. The indicator branch 114 includes a resistor R1, a diode 116, and an LED 118. When the switch 102 is manipulated to create a connection between the AC power 104 and the first side 106, the diode 116 provides rectification, a voltage step down, and LED 118 reverse bias protection. The resistor R1 provides a current limiting function, while the LED 118 provides an indicator light to indicate that valve A 110 has been selected. If desired, any of a broad variety of indicating devices may be used in place of the indicator branch 114, and the configuration shown is merely illustrative of one embodiment.

The first side 106 also includes a delay function block 150. Included in the delay function block 150 is a resistor R2, a first rectifying diode 130, two capacitors C1, C2, a first relay coil 132. The first relay coil 132 is configured to sense the voltage across the two capacitors C1, C2 and, depending on whether the voltage (current) is below or above a threshold value, either opens or closes a first contact 134 and a second contact 136 of a first relay (K1), respectively. The first contact 134 either prevents or allows power to reach valve A 110. The second contact 136 can short a portion of the circuit shown in the second side 108, as will be further explained below. A second contact 146 of a second relay (K2) is placed as shown to allow the second contact 146 to short out the voltage across the capacitors C1 and C2, as well as the first relay coil 132, if the second relay coil 142 on the second side 108 senses a voltage (current) that is above a predetermined threshold.

Similarly, the second side 108 includes an optional indicator branch 120 which, again, includes a resistor R3 that provides a current limiting function to a rectifying diode 122 and an LED 124. The second side 108 further includes a delay function block 152 that has a resistor R4, a second rectifying diode 140, two capacitors C3 and C4, and a second relay coil 142. The second relay coil 142 is designed in similar fashion to the first relay coil 132 and closes or opens a first contact 144 and a second contact 146 of a second relay (K2).

It should be noted at frequencies inherent with this circuit during operation of the two delay function blocks 150 and 152, the relay coils 132 and 142 may essentially be modeled as resistors. For example, in the illustrative embodiment explained below, the relay coils have a value of about 2800 ohms. Thus, the relay coil "resistors" and the capacitors C1, C2 or C3, C4 are placed in parallel. This creates an RC circuit having a time constant defined by the resistive value of the relay coil 132, 142 and the combined capacitance of the capacitors C1, C2 or C3, C4.

FIG. 5 illustrates a chart listing a number of "states" for the system illustrated in FIG. 4. The "states" are merely used for the purpose of simplifying an explanation of the operation of the illustrative example circuit of FIG. 4. The following explanation uses both the states listed in FIG. 5 and the reference numerals of FIG. 4.

Note also that, to prevent instability, the relay coils 132, 142 are explained herein as including an optional hysteresis feature and having different threshold open and close voltages. The hysteresis feature causes the threshold open voltage to be separated from the threshold close voltage such that ordinary noise in the input signal to the relay coils 132, 142 will not cause the relay contacts 134, 136, 144, 146 to quickly and repeatedly open and close (e.g. contact chatter). It should also be understood that while the following description is written in terms of positive voltages causing and driving events, a description and devices relying on "negative" voltages can also be employed, if desired.

As noted in FIG. 5, E1 and E2 are times at which, given the time constants of the first and second delay function blocks 150, 152, the threshold closing voltages of the relay coils 132, 142 are crossed going up, while D1 and D2 are the times at which the threshold opening voltages of the relay coils 132, 142 are crossed going down.

State 1 is one in which the system is steady with valve B 112 on, having the main switch 102 set to side two 108. In State 1, the second relay coil 142 is supplied with a voltage (current) that is greater than its threshold opening voltage, TO2, such that the second relay contacts 144, 146 are closed and valve B 112 is on while the first relay coil 132 is shorted. With the first relay coil 132 shorted and side two selected, both first relay contacts 134, 136 are open, and valve A 110 is off.

State 2 begins at time X, when the main switch 102 has just been flipped from side two 108 to side one 106, preventing power from flowing from the main switch 102 to valve B 112. Because of the delay function blocks 150, 152, the change of the main switch 102 does not immediately change the voltages across either relay coil 132, 142. The second delay function block 152 holds a voltage that is greater than TO2 and decaying in accordance with its time constant, keeping the second relay contacts 144, 146 closed. Because the second relay second contact 146 is closed, the first relay coil 132 is shorted so the first relay contacts 134, 136 are open. In addition, because the first relay coil 132 is shorted, the delay function block 150 does not begin accumulating charge.

State 3 begins a time period D2 after time X. At this time, the second delay function block 152 provides a voltage that drops below the threshold voltage at which the second relay coil 142 opens the second relay contacts 144, 146. Thus the second relay coil 142 opens the second relay contacts 144, 146, allowing the first delay function block 150 to begin charging the first relay coil 132. Because it was previously shorted, the first delay function block 150 and the first relay coil 132 begin at a low voltage below TC1, the threshold voltage at which the first relay coil 132 closes the first relay contacts 134, 136. With the second relay second contact 146 opened, the first delay function block 150 and first relay coil 132 begin charging.

State 4 occurs at a time which is E1 plus D2 after time X. At this time, the first delay function block 150 has charged sufficiently to reach voltage TC1, the threshold voltage at which the first relay coil 132 closes the first relay contacts 134, 136. Once the first relay contacts 134, 136 are closed, valve A 110 turns on and the second relay coil 142 is shorted.

State 4 leads to state 5, which is a steady state in which valve A 110 is operating and the main switch 102 remains in side one 106. In state 5 the first relay coil 132 is above both voltage TC1 (closing the first relay contacts 134, 136) and voltage TO1 (keeping the first relay contacts closed 134, 136), which may be equal to or less than TC1 to provide a hysteresis effect. With the main switch 102 remaining at side one 106 and, with the first relay first contact 134 closed, valve A is on. With the first relay coil 132 above voltage TO1, the first relay second contact 136 remains closed and shorts the second relay coil 142, in turn keeping the second relay contacts 144, 146 open and valve B 112 off.

State 6 occurs after state 5 at some time Y when the main switch 102 is manipulated to select side two 108. With the main switch 102 selecting side two 108, valve A 110 shuts down and the burner turns off. The first delay function block 150 keeps the voltage across the first relay coil above voltage TO1, so the first relay contacts 134, 136 cannot yet open. With the first relay second contact 136 closed, of course, the second relay coil 142 remains shorted and the second delay function block 152 cannot begin charging. With the second relay coil 142 shorted, the second relay contacts 144, 146 remain open. During state 6, the first relay coil 132 acts as a resistor, allowing energy to drain from the capacitors C1, C2 in the first delay function block 150, such that the voltage across the first relay coil 132 decays over time.

State 7 begins a time D1 after time Y, once the voltage supplied to the first relay coil 132 drops below the threshold open voltage TO1. At this time, the first relay contacts 134, 136 are opened. Once the first relay second contact 136 opens, the second delay function block 152 begins charging its capacitors C3, C4. Because the second relay coil 142 and the capacitors C3, C4 were shorted in state 6, they begin with very little charge, less than voltage TC2, the threshold voltage at which the second relay coil 142 closes the second relay contacts 144, 146. Thus the second relay first contact 144 remains open, disabling valve B 112 and keeping the burner off.

State 8 occurs at a time D1 plus E2 after the time Y at which the main switch 102 was manipulated to select side two 108. At this time, the second delay function block 152 has reached a voltage equal to TC2 and provides it to the second relay coil 142. The second relay contacts 144, 146 close in response to the crossing of the threshold closing voltage for the second relay coil 142. With the second relay first contact 144 closed, valve B 112 is enabled and the burner turns on. With the second relay second contact 146 closed, the first relay coil 132 and first delay function block 150 are shorted.

It may be noted that during States 2 and 6, the provision of the rectification diodes 130, 140 substantially prevents energy stored in the delay function blocks 150, 152 from powering either valve 110, 112. This provides consistency regardless of the type of valve used from the perspective of the safety switch 100.

State 9 occurs when the main switch 102 is switched to the center off position 121. In state 9, the first switch contacts 134, 136 and the second switch contacts 144, 146 are both open, and thus both the first valve 110 and the second valve 112 are off, thereby preventing either fuel from reaching the burner.

FIGS. 6–9 are graphs illustrating simulated voltage levels as a function of time across the relay coils of FIG. 4 as the main switch is manipulated from powering a first side to powering a second side with various component failures assumed. The presumed failures are all the opening of capacitors, which can be treated as if an individual capacitor is completely removed from the circuit. In the graphs shown in FIGS. 6–9, the illustrated traces represent voltages across the relay coils of a circuit as in FIG. 4. For graphs 160, 170, 180, 190, the upper traces 162, 172, 182, 192 correspond to the voltages across the first relay coil 132, and the lower traces 164, 174, 184, 194 correspond to the voltages across the second relay coil 142, respectively.

Figure 6:
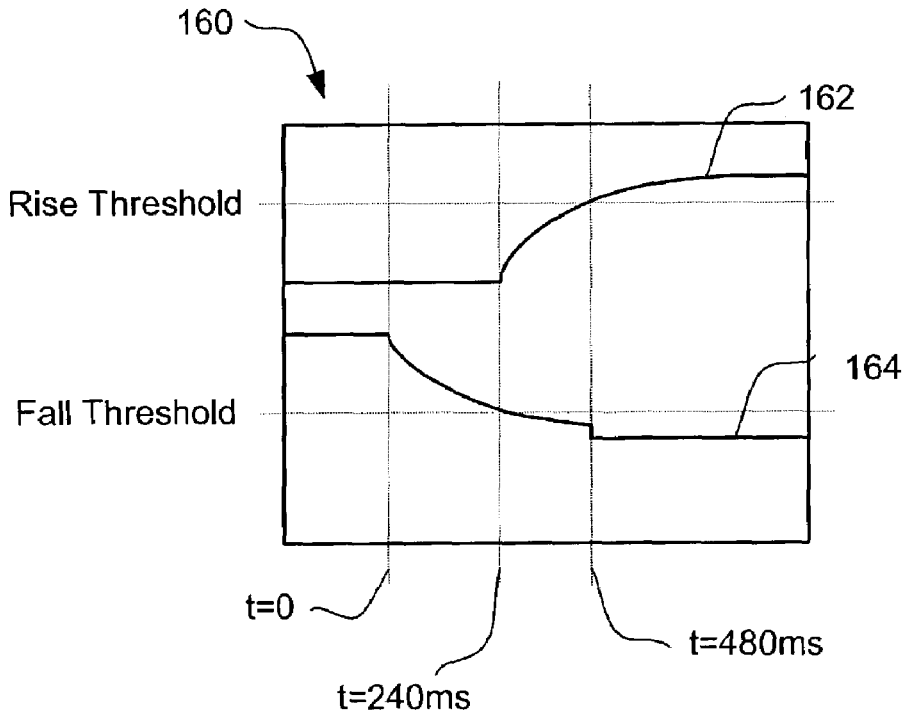
FIGS. 6–9 are graphs representing voltage levels across the relay coils of FIG. 4 as the main switch is manipulated from powering a first side to powering a second side in various failure modes.

Referring to FIG. 6, the graph 160 illustrates graphically the voltages that occur across the relay coils 132, 142 (FIG. 4) when the main switch 102 (FIG. 4) is manipulated to select the first side 106 (FIG. 4) after the second side 108 (FIG. 4) has been selected for some period of time. Before (to the left of) time t=0, which corresponds to time X in FIG. 5, the lower trace 164 is well above a Fall Threshold voltage, which is the voltage at which, when falling, the second relay coil 142 (FIG. 4) will open its respective contacts 144, 146 (FIG. 4). At t=0, the main switch 102 (FIG. 4) is manipulated to select the first side 106 (FIG. 4). Thus power is provided to the first delay function block 150 (FIG. 4) and not to the second delay function block 152 (FIG. 4) after (to the right of) t=0. The upper trace 162 remains flat before t=240 milliseconds, however, because the second relay second contact 146 (FIG. 4) remains closed, the first relay coil 132 (FIG. 4) remains shorted.

At t=240 milliseconds in FIG. 6, the lower trace 164 crosses the Fall Threshold. At this time, the upper trace 162 begins to rise as the second relay coil 142 (FIG. 4) allows the second relay contacts 144, 146 (FIG. 4) to open such that the first delay function block 150 (FIG. 4) begins to charge. The upper trace 162 continues to rise, and crosses a Rise Threshold at about t=480 milliseconds. When the upper trace 162 crosses the Rise Threshold, the first relay coil 132 (FIG. 4) reaches a threshold voltage for closing the first relay contacts 134, 136 (FIG. 4). When the first relay first contact 134 (FIG. 4) closes, valve A 110 (FIG. 4) is powered and begins operation. At the same time, the lower trace 164 undergoes a sudden drop to a flat zero level, which occurs as the first relay second contact 136 (FIG. 4) closes, shorting the second relay coil 142 (FIG. 4).

The illustrative graphs of FIGS. 6–9 assume a structure similar to that shown in FIG. 4 for the underlying schematic. The exact time constants of the RC delay function blocks 150, 152 (FIG. 4), while directly relevant, may not be the only factor which determines when the relays change state. Rather than a 63% drop in amplitude, which is used to define a "time constant," it is the drop relative to a threshold for each of the relay coils 132, 142 (FIG. 4) that determines when switching occurs. Also, the specific times values illustrated in FIG. 6 are only illustrative and not limiting.

Figure 7:
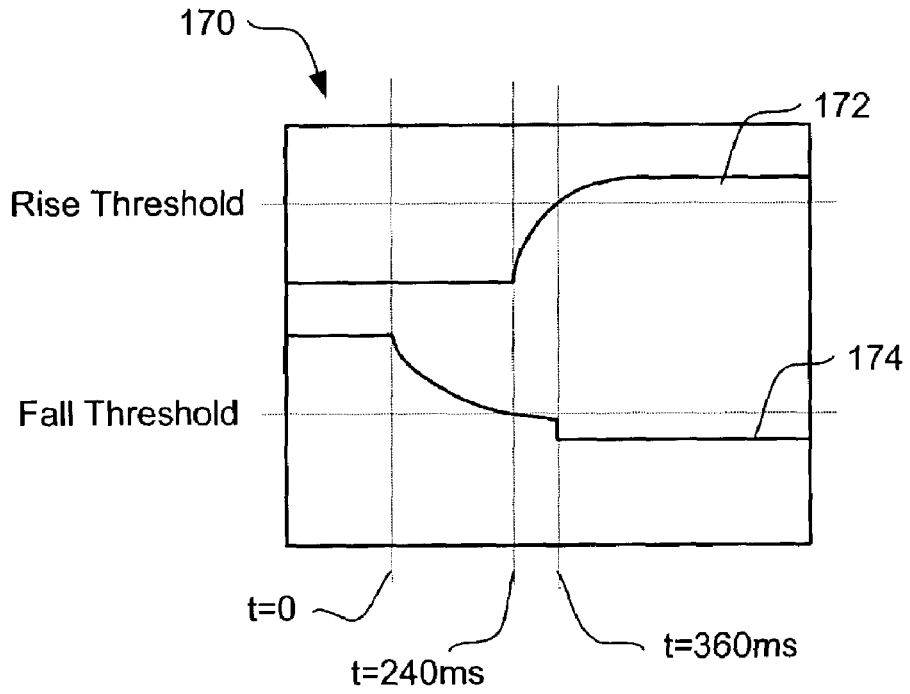

FIG. 7 assumes that one of the capacitors C1, C2 (FIG. 4) of the first side 106 (FIG. 4) has been removed from the circuit (e.g. failed open). This causes a reduction in the effective capacitance of that portion of the circuit, and, consequently, reduces the RC time constant of that portion of the circuit, making for a steeper curve on the graph. Therefore, as shown in FIG. 7, the drop of the lower trace 174 to the Fall Threshold is very similar to that of FIG. 6, but the rise of the upper trace 172 is quite a bit steeper, beginning at t=240 milliseconds and reaching Rise Threshold by t=360 milliseconds, rather than t=480 milliseconds as in FIG. 6.

Figure 8:
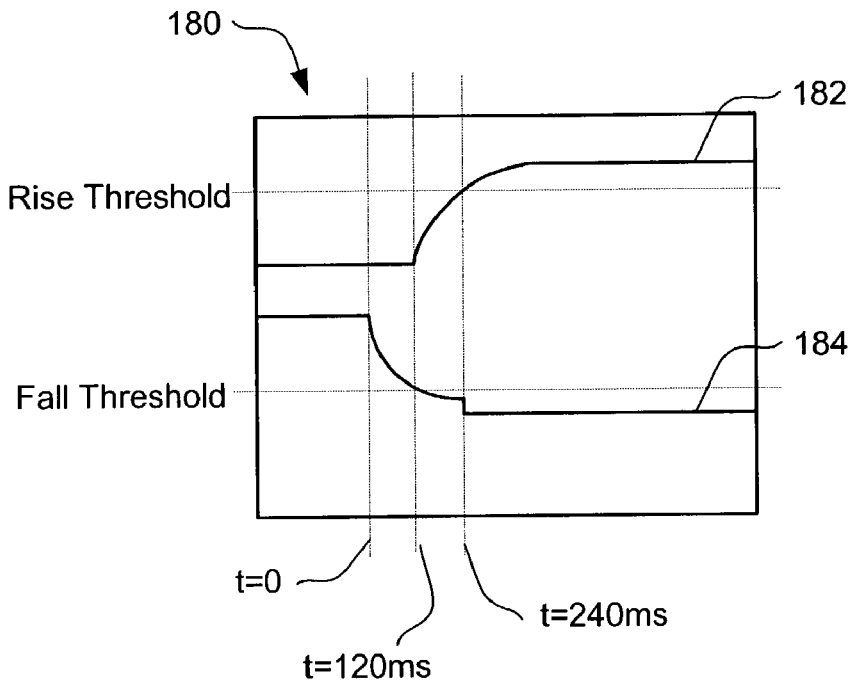
Figure 9:
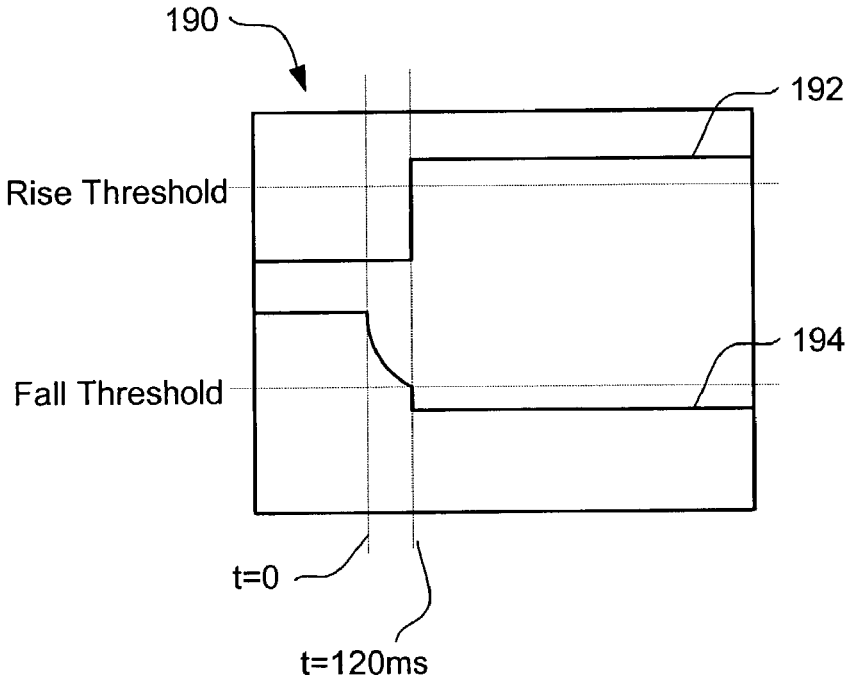

FIG. 8 shows a similar effect as in FIG. 7, except this time, a capacitor is removed from both sides 106, 108 (FIG. 4) of the circuit. As shown in FIG. 8, both traces 182, 184 are characterized by steeper and quicker changes. The Fall Threshold is crossed by the lower trace 184 at 120 milliseconds, while the Rise Threshold for the upper trace 182 is crossed at 240 milliseconds, one half of that shown in FIG. 6. FIG. 9 takes a further step, removing a third of the four capacitors and leaving only a capacitor in the second side 108 (FIG. 4) of the circuit. Still, even with three of the four more vulnerable elements of the circuit in FIG. 4 removed, a sufficient switch time remains at 120 milliseconds.

By selecting and pairing the elements of the circuit of FIG. 4 properly, the redundancy of the several capacitors may allow for relatively great safety even if several elements fail. In the illustrative embodiment, a minimum 42 millisecond delay may be required to ensure safe operation of the fuel selection switch. However, this time is nearly tripled by the 120 millisecond delay shown in FIG. 8. It should be noted that, while in some circumstances the added redundancy of the four capacitors C1, C2, C3, C4 (FIG. 4) is useful, it is not necessary in all embodiments of the invention.

Other failures may occur as well, but hazardous consequences (i.e. a lack of proper delay before valve 110 de-energizes and valve 112 energizes, or visa-versa) can be avoided unless several different devices fail simultaneously in particular circumstances. If a capacitor shorts out, whichever side the shorted capacitor is on will be disabled. For example, if capacitor C1 shorts out, the first relay coil 132 gets shorted, so that neither of the first relay contacts 134, 136 can close, and valve A 110 would receive no power. If a relay coil 132, 142 becomes non-responsive to applied voltage and closes both associated contacts, the opposite branch 108, 106 from the relay coil 132, 142 that failed will be disabled. On the other hand, if a relay coil 132, 142 becomes non-responsive to applied voltage and opens both associated contacts, the side 106, 108 with the failed relay coil 132, 142 is disabled. If a rectifying diode 130, 140 fails, the adjacent reactive circuit 150, 152 will fail to charge adequately to ever trigger the associated relay coil 132, 142, disabling the valve 110, 112 on the side 106, 108 of the failed rectifying diode 130, 140.

If a first contact 134, 144 of either relay becomes permanently closed, the side 106, 108 having the failed first contact 134, 144 will turn on as soon as the main switch 102 is flipped, which would create a potentially hazardous situation. This is so because one valve 110, 112 would come on immediately without allowing recycling after the other valve 112, 110 turns off. Therefore the relays should be chosen such that, if a first contact 134, 144 fails, it becomes permanently opened thereby disabling the associated valve 110, 112. Alternatively, the relays should be chosen such that both the first contact 134, 144 and the second contact 136, 146 always have the same response such that one cannot be stuck open while the other is closed. This is typically referred to as pole contact tracking. If such relays are chosen, then a failure which results in the closing of both first contacts 134 or 144 and second contacts 136 or 146 of a relay would disable the valve 112 or 110 by shorting the other relay coil 142, 132. More preferably, however, the relays should simply be chosen to have a rating with sufficient margin to handle the applied currents, and sufficiently tested to help ensure that they do not produce an unsafe condition.

A working example was constructed using the configuration of FIG. 4. With a 120 VAC source, a single pole center off rocker switch was used as the main switch 102. R1 and R3 were selected as 6800 ohm, two watt resistors, while R2 and R4 were selected to be 5600 ohm, two watt resistors. Each capacitor C1, C2, C3, C4 was chosen as a thirty-three microfarad capacitor. Two LED's were chosen to provide the optional indicator lights, and four 1N4007 diodes used to provide rectification. The relays selected had about 2800 ohms of resistance in the relay coils 132, 142 (FIG. 4).

In testing, the components appeared to have significant mismatch in some respects, because the results are functional though imperfect. Traces were taken across the relay coils 132, 142 (FIG. 4) while the system was switched from selecting side two to side one and from side one to side two. Two runs were performed, the first set with all components in place and the second set with one capacitor removed from each side. FIGS. 10A, 10B and 11A, 11B illustrate the results with approximate times shown as well. It can be seen that, while the results are not exactly in accordance with the estimations in FIGS. 6–9, the safety of the system even with multiple capacitors failing to operate (i.e. removed) is quite clear.

Figure 10A:
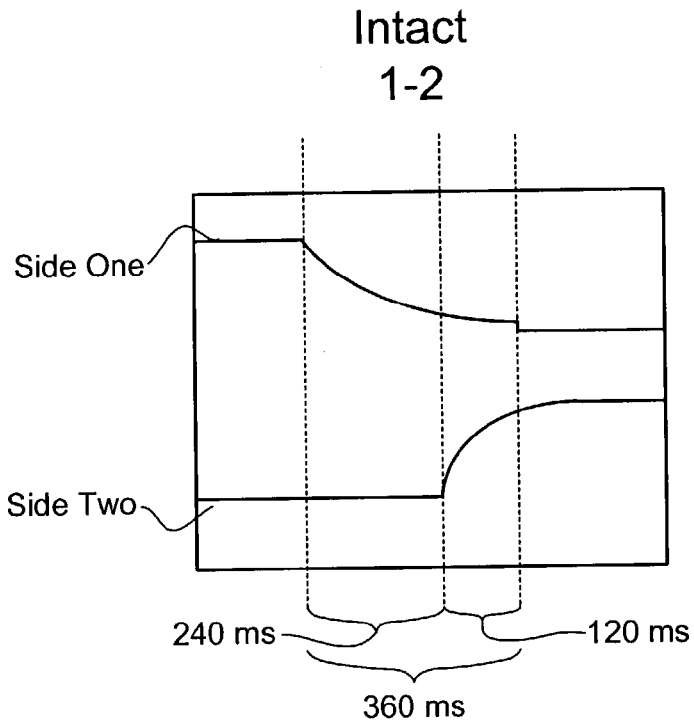
FIGS. 10–11 are graphs approximating the results of normal and failure mode testing of a working example illustrative switch.

FIG. 10A shows the traces as the functioning system was switched from powering a first user to powering a second user. Trace Side One is the voltage across the a first relay coil 132 (FIG. 4), and trace Side Two is the voltage across a second relay coil 142 (FIG. 4). 240 milliseconds passed between the time the main switch 102 (FIG. 4) was switched and when the Side Two voltage begins to change. This time is the period during which the first reactive circuit 150 (FIG. 4) discharges down to threshold where the first relay second side 136 (FIG. 4) opens. Once the first relay second side 136 (FIG. 4) opens, the second reactive circuit 152 (FIG. 4) begins charging and the voltage across the second relay coil 142 (FIG. 4) begins to rise. After another 120 milliseconds pass, the Side One voltage drops off sharply. The sharp drop off corresponds to the time when the second relay coil 142 (FIG. 4) voltage crosses a closing threshold, which causes the second relay second side 146 (FIG. 4) to close and short the first reactive circuit 150 (FIG. 4). This is also the time at which the second relay first side 144 (FIG. 4) closes, allowing the second fuel valve to receive power. Thus, in the illustrative embodiment, there is a 360 millisecond delay from when the first fuel valve loses power to when the second fuel valve receives power.

Figure 10B:
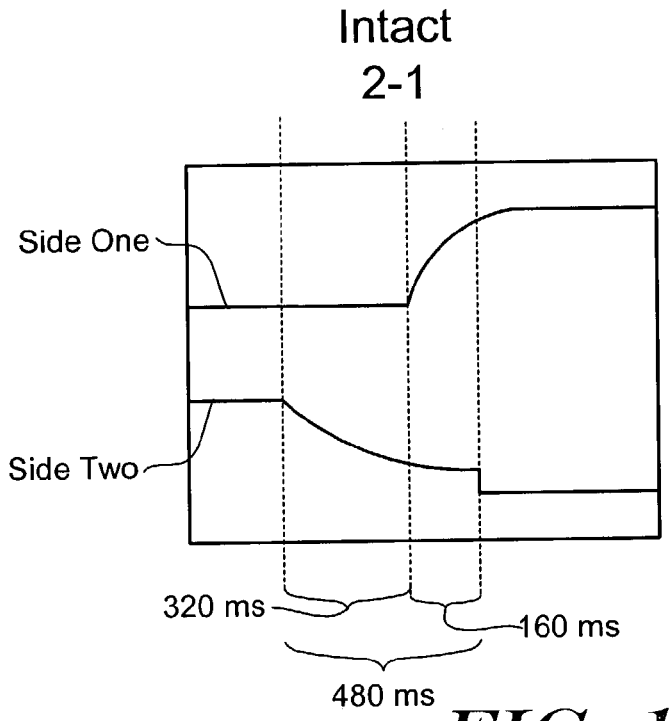
Figure 11A:
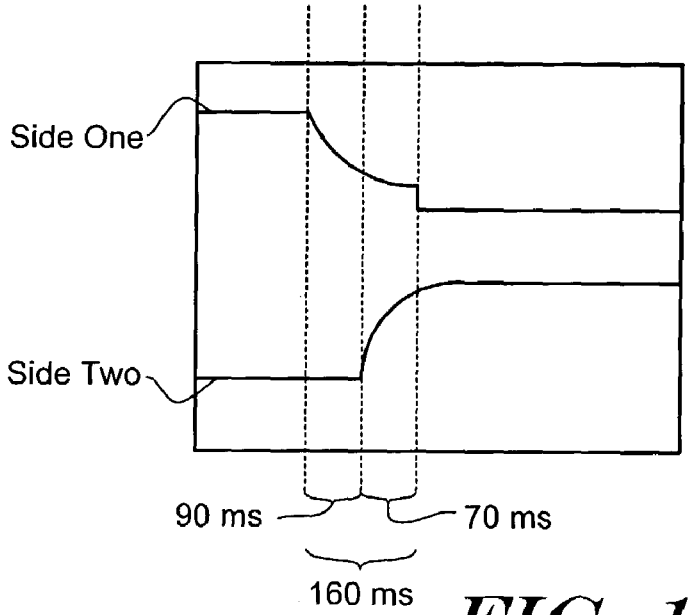
Figure 11B:
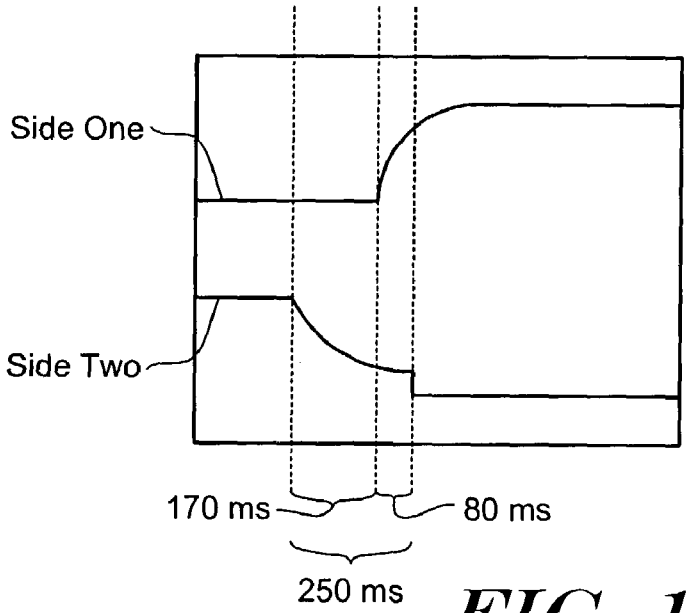

In like fashion, FIG. 10B illustrates a 480 millisecond delay after the changing of the main switch 102 (FIG. 4) from side two to side one. The difference may be attributed to device mismatching, including, for example, variation in actual resistance of the relays, and variations in the actual threshold voltages of the relays. FIGS. 11A and 11B illustrate similar phenomena, however, for the tests of FIGS. 11A and 11B, a capacitor C1, C3 (FIG. 4), was removed from each of the two reactive circuits 150, 152 (FIG. 4). The delay times reduce to 160 milliseconds and 250 milliseconds, respectively. These delays are still well in excess of that required by present safety regulations. Further, it may be noted that the individual delays of each of the particular reactive circuits 150, 152 (FIG. 4) are all greater than the 42 millisecond delay required by the illustrative embodiment. The shortest delay is about 70 milliseconds, which corresponds to the rise time for side two in FIG. 11A.

While the electronic switch of the present invention is preferably used as an electronic fuel selection switch, many other applications are contemplated. It is contemplated that the present invention may be used in any application where a delay is desirable between the deselection of one state and the selection of another. Furthermore, those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A delay switch comprising:

a main switch having a first selection terminal and a second selection terminal, the main switch adapted such that at most one of the selection terminals provides an output at a time;

a first switch electrically connected between the first selection terminal and a first load, the first switch having a control input that controls whether the first switch is closed or open relative to the first load;

a second switch electrically connected between the second selection terminal and a second load, the second switch having a control input that controls whether the second switch is closed or open relative to the second load; and a first delay circuit having an input and an output, the input of the first delay circuit is electrically connected to the first selection terminal of the main switch, and the output of the first delay circuit is electrically connected to the control input of the first switch, the first delay circuit providing a delay between a change on the first selection terminal of the main switch and a corresponding change on the control input of the first switch.

2. A delay switch according to claim 1 further comprising:

a second delay circuit having an input and an output, the input of the second delay circuit is electrically connected to the second selection terminal of the main switch, and the output of the second delay circuit is electrically connected to the control input of the second switch, the second delay circuit providing a delay between a change on the second selection terminal of the main switch and a corresponding change on the control input of the second switch.

3. A delay switch according to claim 2 further comprising:

a third switch having a control input that controls whether the third switch is closed or open, the third switch causing the control input of the first switch to open the first switch when the third switch is closed.

4. A delay switch according to claim 3 wherein the control input of the third switch is related to the control input of the second switch.

5. A delay switch according to claim 4 further comprising:

a fourth switch having a control input that controls whether the fourth switch is closed or open, the fourth switch causing the control input of the second switch to open the second switch when the fourth switch is closed.

6. A delay swatch according to claim 5 wherein the control input of the fourth switch is related to the control input of the first switch.

7. A delay switch according to claim 6 wherein the first switch and the fourth switch are two different commonly controlled poles of a first relay.

8. A delay switch according to claim 7 wherein the second switch and the third switch are two different commonly controlled poles of a second relay.

9. A delay switch according to claim 2 wherein the first delay circuit is a first reactive circuit, and the second delay circuit is a second reactive circuit.

10. A delay switch according to claim 9 wherein the first switch is a relay that includes a relay coil that is part of the first reactive circuit.

11. A delay switch according to claim 10 wherein the second switch is a relay that includes a relay coil that is pan of the second reactive circuit.

12. A delay switch according to claim 1 wherein the first load is a first fuel valve.

13. A delay switch according to claim 12 wherein the second load is a second fuel valve.

14. A delay switch according to claim 1 wherein the main switch further includes a center off position.

15. A method of providing a delay switch for selecting between a number of fuel valves, the method comprising:

providing a first switching device and a second switching device, the first and second switching devices having inputs, outputs, and control terminals, each control terminal controlling whether the input is electrically coupled to the output, the first and second switching devices having a threshold open voltage and a threshold close voltage;

providing a first reactive circuit and a second reactive circuit, each having a time constant and an output;

coupling the first switching device to the output of the first reactive circuit and the second switching device to the output of the second reactive circuit;

coupling the first reactive circuit to receive power when a first fuel valve is selected; and coupling the second reactive circuit to receive power when a second fuel valve is selected;

wherein:

the first switching device controls whether power is connected to the first fuel valve; and the second switching device controls whether power is connected to the second fuel valve.

16. The method of claim 15 wherein:

the first switching device is coupled to the second reactive circuit such that the first switching device can modify the output of the second reactive circuit; and the second switching device is coupled to the first reactive circuit such that the second switching device can modify the output of the first reactive circuit.

17. The method of claim 16 further comprising providing a main switch for selecting between the number of fuel valves.

18. The method of claim 17 further comprising coupling the main switch to selectively provide power to a path for providing power to the first fuel valve or a path for providing power to the second fuel valve.

19. The method of claim 18 wherein:

the first reactive circuit is coupled to receive power from the path for providing power to the first fuel valve; and the second reactive circuit is coupled to receive power from the path for providing power to the second fuel valve.

20. The method of claim 17 wherein:

the first reactive circuit receives power from an output of the main switch;

the second reactive circuit receives power from an output of the main switch; and power received by the fuel valves is not supplied through the main switch.

21. The method of chum 15 further comprising providing a main switch configured to selectively provide power to the first reactive circuit and the second reactive circuit.

22. The method of claim 21 further comprising:

coupling the first switching device to the second reactive circuit such that the first switching device can modify the output of the second reactive circuit; and coupling die second switching device to the first reactive circuit such that the second switching device can modify the output of the first reactive circuit.

23. A system for controlling power supply to fuel valves of a multi-fuel source burner, the system comprising:

a main switch for switching between a first fuel source and a second fuel source;

a first relay device for opening or closing a circuit for powering a first fuel valve, the first relay device having a threshold closing voltage such that, if an input voltage supplied to the first relay device is above the threshold closing voltage, the first relay device closes the circuit for powering the first fuel valve; and a first reactive circuit for providing an input voltage to the first relay device;

wherein:

a first output of the main switch is coupled to the first reactive circuit and to the circuit for powering the first fuel valve; and the first reactive circuit has a time constant relative to the threshold voltage of the first relay device that is selected to provide at least a predetermined delay before the first fuel valve receives power.

24. The system of claim 23 further comprising:

a second relay device for opening or closing a circuit for powering a second fuel valve, the second relay device having a threshold closing voltage such that, if an input voltage supplied to the second relay device is above the threshold closing voltage, the second relay device closes the circuit for powering the second fuel valve; and a second reactive circuit for providing an input voltage to the second relay device;

wherein:

a second output of the main switch is coupled to the second reactive circuit and to the circuit for powering the second fuel valve; and the second reactive circuit has a time constant relative to the threshold voltage of the second relay device that is selected to provide at least a predetermined delay before the second fuel valve receives power.

25. The system of claim 24 wherein:

the first relay device is coupled to the second reactive circuit such that, when the input voltage supplied to the first relay device is above the threshold closing voltage, the first relay device prevents the input voltage supplied to the second relay device from rising above the threshold closing voltage of the second relay device.

26. The system of claim 24 wherein:

the first relay device is coupled to the second reactive circuit such that, when the input voltage supplied to the first relay device is above the threshold closing voltage, the first relay device shorts the second reactive circuit.

27. The system of claim 25 wherein:

the second relay device is coupled to the first reactive circuit such that, when the input voltage supplied to the second relay device is above the threshold closing voltage, the second relay device prevents the input voltage supplied to the first relay device from rising above the threshold closing voltage of the first relay device.

28. The system of claim 26 wherein:

the second relay device is coupled to the first reactive circuit such that, when the input voltage supplied to the second relay device is above the threshold closing voltage, the second relay device shorts the first reactive circuit.

29. A delay switch comprising:

a main switch, the main switch having an input, a selector and first and second output terminals, wherein the main switch is adapted to couple the input to at most one of the output terminals at a time;

a first switch having a control terminal, an input, and an output, the output adapted for coupling to an electrical load and the control terminal coupled to the first output terminal of the main switch, wherein the first switch is adapted to selectively couple the input to the output in response to a signal applied to the control terminal;

a second switch having a control terminal, an input, and an output, the output adapted for coupling to an electrical load and the control terminal coupled to the second output terminal of the main switch, wherein the second switch is adapted to selectively couple the input to the output in response to a signal applied to the control terminal; and a first delay circuit having an input and an outputs the input of the first delay circuit being electrically connected to the first output terminal of the main switch, and the output of the first delay circuit being electrically connected to the control terminal of the first switch, the first delay circuit providing a delay between a change on the first output terminal of the main switch and a corresponding change on the control terminal of the first switch.

30. A delay switch according to claim 29 further comprising:

a second delay circuit having an input and an output, the input of the second delay circuit being electrically connected to the second output terminal of the main switch, and the output of the second delay circuit being electrically connected to the control terminal of the second switch, the second delay circuit providing a delay between a change on the second output terminal of the main switch and a corresponding change on the control terminal of the second switch.

31. A delay switch according to claim 30 further comprising:

a third switch having a control terminal that controls whether the third switch is closed or open, the third switch causing the control terminal of the first switch to open the first switch when the third switch is closed; and a fourth switch having a control terminal that controls whether the fourth switch is closed or open, the fourth switch causing the control terminal of the second switch to open the second switch when the fourth switch is closed.

32. A delay switch according to claim 30 wherein:

the first delay circuit is a first reactive circuit;

the second delay circuit is a second reactive circuit;

the first switch is a relay that includes a relay coil that is part of the first reactive circuit; and the second switch is a relay that includes a relay coil that is part of the second reactive circuit.

33. A delay switch comprising:

a main switch having an input and at least a first output, the main switch selectively coupling the input to no more than one of the outputs at a time;

a first switch having a control terminal, an input and an output, the control terminal of the first switch controlling whether the input is electrically coupled to the output; and a first delay circuit having an input and an output, the input of the first delay circuit being electrically connected to the first output of the main switch, and the output of the first delay circuit being electrically connected to the control terminal of the first switch, the first delay circuit providing a delay between a voltage change on the first output of the main switch and a corresponding voltage change on the control terminal of the first switch;

a second switch having a control terminal, an input and an output, the control terminal of the second switch controlling whether the input is electrically coupled to the output; and a second delay circuit having an input and an output, the input of the second delay circuit being electrically connected to a second output of the main switch, and the output of the second delay circuit being electrically connected to the control terminal of the second switch, the second delay circuit providing a delay between a voltage change on the second output of the main switch and a corresponding voltage change on the control terminal of the second switch.

34. The delay switch of claim 33 further comprising:

a third switch associated with the first switch, and a fourth switch associated with the second switch, the third and fourth switches having inputs, outputs, and control terminals controlling whether the inputs are coupled to the outputs, the third switch and the fourth switch receiving signals at their respective control terminals related to signals received at the respective first and second switch control terminals;

circuitry coupling the input and output of the third switch to the second delay circuit such that, when the third switch is in a state coupling the third switch input to the third switch output, the second delay circuit is disabled; and circuitry coupling the input and output of the fourth switch to the first delay circuit such that, when the fourth switch is in a state coupling the fourth switch input to the fourth switch output, the first delay circuit is disabled.

* * * * *